United States Patent [19]

Sawluk

[11] Patent Number: 4,974,367

[45] Date of Patent: Dec. 4, 1990

[54] METHOD OF AN ARRANGEMENT FOR GRINDING WORKPIECES WITH PROFILES

[75] Inventor: Wlodzimierz Sawluk, Hamburg, Fed. Rep. of Germany

[73] Assignee: Firma Ernst Winter & Sohn (GmbH & Co.), Hamburg, Fed. Rep. of Germany

[21] Appl. No.: 455,636

[22] Filed: Dec. 22, 1989

Related U.S. Application Data

[63] Continuation-in-part of Ser. No. 223,601, Jul. 25, 1988, abandoned.

[30] Foreign Application Priority Data

Jul. 29, 1987 [DE] Fed. Rep. of Germany ..... 3725024

[51] Int. Cl.[5] ..... B24B 7/00

[52] U.S. Cl. ..... 51/5 D; 51/288; 51/325

[58] Field of Search ..... 51/5 D, 288, 325; 125/11 C, 11 D

[56] References Cited

U.S. PATENT DOCUMENTS

| | | | |
|---|---|---|---|
| 2,981,038 | 4/1961 | Flanders | 51/288 |
| 3,243,923 | 4/1966 | Karavias | 51/288 |
| 3,403,479 | 10/1968 | Ferreirinha | 51/105 |
| 3,524,283 | 8/1970 | Jones | 51/5 |
| 3,553,893 | 1/1969 | Stade | 51/5 |
| 3,943,664 | 3/1976 | Broide et al. | 51/5 D |

FOREIGN PATENT DOCUMENTS 3238691 4/1984 Fed. Rep. of Germany .

*Primary Examiner*—J. J. Hartman
*Attorney, Agent, or Firm*—Michael J. Striker

[57] ABSTRACT

Grinding of non-round workpieces with plunge cutting on circular grinding machines is performed by a grinding disc which is coupled with a dressing roller and which is also kinematically coupled to a workpiece, so that the grinding is performed in condition of the kinematic coupling.

7 Claims, 9 Drawing Sheets

METHOD OF AN ARRANGEMENT FOR GRINDING WORKPIECES WITH PROFILES

CROSS-REFERENCE TO A RELATED APPLICATION

This application is a continuation-in-part of application Ser. No. 223,601 filed on July 25, 1988, now abandoned.

BACKGROUND OF THE INVENTION

The present invention relates to a method of and an arrangement for grinding of non-round workpieces with profiles, by plunge cutting on circular grinding machines with the use of a dressing roller which is kinematically coupled with a grinding wheel.

In known methods for producing or final grinding of profiles of workpieces in straight plunge cutting grinding processes, the profile shape of the workpiece and the grinding wheel peripheral surface required for it have their course in an axial direction of the grinding disc or the workpiece. The profiles of the grinding disc and the workpiece have in their respective peripheral region no deviations from a circular profile shape. However, the profile dimensions in respective portions o such workpieces or grinding wheels can have different diameters.

The German document No. DE-PS 3,029,039 shows grinding wheels which are provided on their peripheral surface with axes-parallel grooves with a depth of from 1 to maximum approximately 1,000 micrometer. These grooves serve to enable using different roughness depths for example for a coarse grinding or a fine grinding. They are arranged for this purpose with angular distances of approximately 1° maximum. This solution deals therefore with microgrooves which form small webs or groove edges located directly therebetween and comparable with cutting edges in their action. For producing these grooves, a dressing roller is used which maintains a fixed speed which is dependent on the number of grooves to be produced on the grinding wheel on the one hand, and on the number of the cutting edges of the dressing roller on the other hand. For this purpose, such a dressing roll is coupled with the grinding wheel by a mechanical transmission in form-locking manner.

Such grinding wheels whose grinding surface in practice is formed as a cylindrical peripheral surface can be also used for grinding polygonal profiles on workpieces. The disadvantage of the grinding process which is used in this case is that the respective grinding machines must have two differently driven supports in the cutting or delivery adjusting direction. One support is required for producing respective movements perpendicularly t the axis of the workpiece forwardly and rearwardly, for obtaining the required profile. The movement of this support is kinematically coupled through a respective transmission with the workpiece to be ground. The second support serves for performing the required delivery movement during grinding which moves in workpiece contact only by hundredth of millimeters.

Attempts have been made to grind a non-round workpiece with a round grinding wheel which rotates with an eccentricity. Such an approach is disclosed in the U.S. Pat. No. 3,403,479. While the method and arrangement disclosed in this reference are capable of grinding the workpieces with non-round contours, they possess several disadvantages. First of all, the eccentrical rotation of the round grinding wheel creates significant imbalance forces which are detrimental to the operation of the device. Moreover, the possibilities of grinding the workpieces are very limited as to the number of possible various shapes.

SUMMARY OF THE INVENTION

Accordingly, it is an object of the present invention to provide a grinding method and arrangement for use in circular grinding machines for grinding profiles, such that a support for producing a respective profile, for example a polygonal profile can be dispensed with.

One support, however, must be maintained, namely such support which supports delivery movement in the workpiece grinding wheel contact in the region of hundredth or thousandth of millimeters.

In keeping with these objects and with others which will become apparent hereinafter, one feature of the present invention resides, briefly stated, in a grinding, in accordance with which a non-round grinding wheel having a plurality of portions with different diameters arranged on a regularly repeated angular positions and having different amplitudes is kinematically coupled with the workpiece so that a rotary speed of the workpiece and a rotary speed of the non-round grinding wheel are determined relative to one another, and the workpiece is ground in condition of its kinematic coupling with the non-round grinding wheel, while dressing of the non-round grinding wheel with the dressing roller kinematically coupled with the non-round grinding wheel is performed to provide predetermined ratios of rotary speeds between the grinding wheel, dressing roller and the workpiece.

It is advantageous when the grinding wheel can be provided by a respective kinematically coupled diamond dressing roller, continuously or in a stepped manner, with a corresponding profile. Then this profile is transmitted from the grinding wheel in the kinematic coupling to the workpiece.

When an involute toothing is to be ground, both the diamond dressing roller and the grinding wheel have for example an involute-shaped tooth profile. This profile is transmitted by the grinding wheel to the workpiece. The toothing of the workpiece can be ground directly to the full extent when a small module is involved. On the other hand, a toothing with high modules can be only post-grinded after hardening which is conventional in the technique on other machine devices.

In the case of an inventive toothing, the diamond dressing roller with the grinding wheel and the workpiece form together a type of transmission, wherein the kinematic coupling or the positive drive of the diamond dressing roller and the workpiece is performed with ratio of the predetermined number of teeth.

Not only such profiles which fall under the definition of splined toothing can be made in accordance with the present invention in a new and highly efficient manner, but also polygonal profiles can also be formed which required for their production a additional support kinematically coupled with the workpiece. In such cases, the grinding wheel is provided by a diamond dressing roller shaped in correspondence with the workpiece, with a shape which is completely unconventional and in particular with such a shape in which the peripheral surface is provided with extremely high visible diameter differences. These diameter differences can amount to 0.5–60 mm. Such a grinding wheel is somewhat star-like in the cross-section and has with regularly repeating angular positions, a profile with different amplitudes.

An important feature or a design of the present invention is the inclined position of the grinding wheel as seen from a common plane between the diamond dressing roller and the workpiece. This position can amount to an angle of the inclination of 25° to the axial direction of the grinding wheel. Such an inclined position is required for producing with predetermined cutting speeds a grinding effect such that the grinding direction forms a resultant from the peripheral speed direction $V_s$ of the grinding wheel and the resultant speed $V_r$ in the axial direction of the workpiece.

The inventive method with the kinematically coupled grinding is not limited only to the working of profiles of the above-described type. It is also possible by selection of the ratio between the rotary speeds of the grinding wheel and the workpiece, to produce with a singularly profiled grinding wheel such as a singular dressing roller, multiple threads of different pitch on the workpiece.

In the event of a singular thread of the grinding wheel and the grinding wheel and the workpiece having identical rotary speeds, a singular thread is produced on the workpiece. When the rotary speed of the workpiece is for example doubled, a double thread is produced, etc. It should be emphasized that the inventive coupled kinematic grinding provides for a plurality of possibilities for its use.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
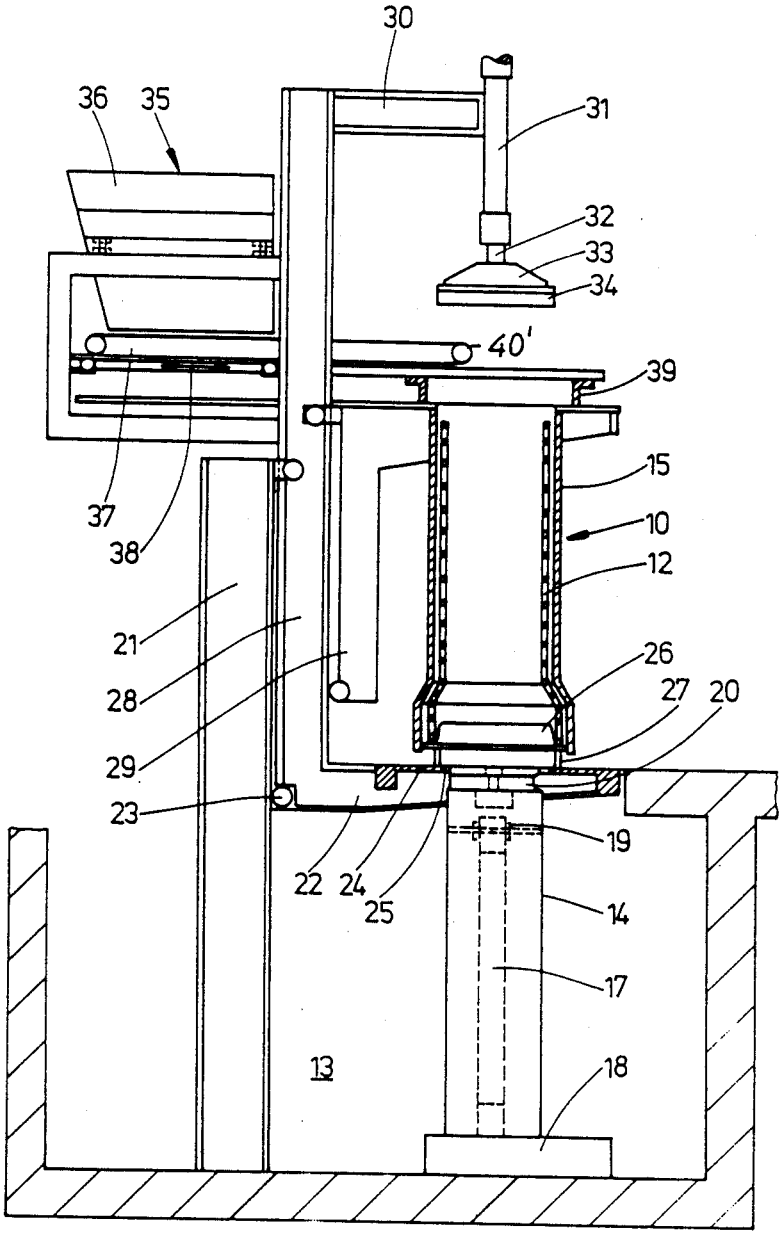
FIG. 1 is a view showing a grinding wheel with a mechanically coupled workpiece and a mechanically coupled dressing roller.

An arrangement for grinding a workpiece 5 is shown in FIG. 1. It has a grinding wheel 1 which is provided with a profile idenitified with reference numeral 2. A dressing roller 3 is kinematically coupled with the grinding wheel 1 and has in turn a profile identified with reference numeral 4. The grinding wheel 1, the dressing roller 3 and the workpiece 5 have different diameters identified respectively as $D_1$, $D_3$ and $D_2$.

For producing a profile 6 on the workpiece 5 by grinding by means of the grinding wheel 1 with its profile 2, the peripheral speeds between the workpiece 5 and the grinding wheel 1 are different. They can be selected and changed by a mechanical kinematic coupling presented with this embodiment and provided between the grinding wheel 1 which is driven b a shaft 8 on the one hand with the workpiece 5, and on the other hand with the dressing roller 3.

For this purpose the drive shaft 8 of the grinding disc 1 is provided with a roller 9, and two endless belts 14 and 16 are arranged on the roller 9 for driving the dressing roller 3 and the workpiece 5. The drive of the workpiece 5 is performed through the belt 16 which moves over a deviating roller 13 and a further belt 17 which moves over a roller 11 of the tool. The drive of the dressing roller 3 is performed through the belt 14 which runs over a deviating roller 12, and a further endless belt 15 which runs over a disc 10.

The deviating rollers 12 and 13 are turnable back and forth in direction of the double arrow 12. They are formed so that the rotary direction from the input to output point can be reversed so that the dressing roller 3 and the workpiece 5 can both rotate in accordance with the arrow in a counterclockwise direction. The above mentioned elements which connect the grinding wheel 1, the dressing roller 3 and the workpiece 5 together form a kinematic coupling or a transmission.

Figure 2:
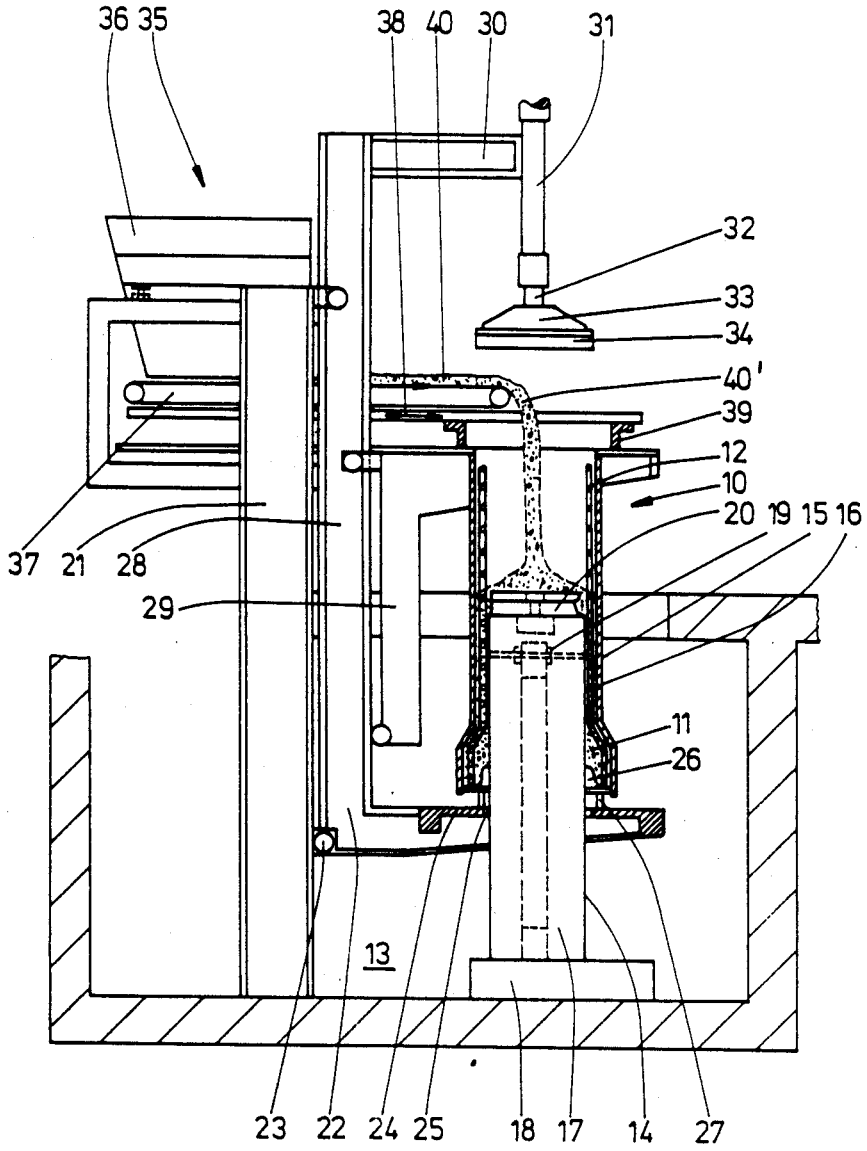
FIG. 2 is a view showing an arrangement for profile grinding on a known circular grinding machine.

The grinding of a profile on a polygon-shaped workpiece 5 in a straight plunge cut grinding process is performed normally in correspondence with FIG. 2, with the utilization of a grinding wheel with a circular peripheral surface on a circular grinding machine with two supports. One of the supports is required for moving the grinding wheel 1 in correspondence with the arrow 21 perpendicularly to the axis of the workpiece 5 forwardly and rearwardly for producing the required profile. The movement of this support in correspondence with the double arrow 21 is kinematically coupled through a respective transmission with the workpiece 5 to be grinded.

The second support which is provided in the known circular grinding machines serves for forming the required delivery movement during grinding in correspondence with the arrow 20, which moves in contact with the workpiece only by hundredth of millimeters.

Figure 3:
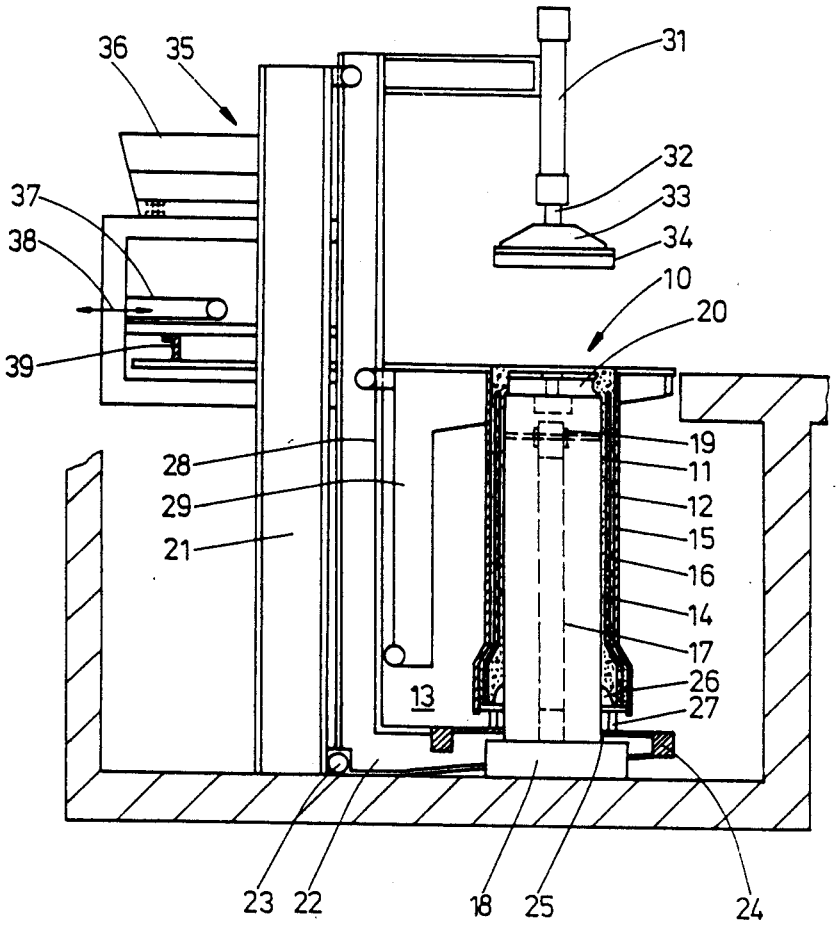
FIG. 3 is a view showing a star-shaped grinding wheel with a profile workpiece.

By mechanical or kinematic coupling of the grinding wheel 1 with the workpiece 5 as shown in FIG. 1 it is possible in correspondence with FIG. 3 to perform with a suitably shaped guiding wheel 1 with advancement of the support and with the reciprocating movement in correspondence with the arrow 21 in FIG. 2 only with continuous delivery in correspondence with the arrow 20, a grinding of a polygon-shaped workpiece 5. For this purpose the grinding wheel 1 is formed substantially star-like. In other words, the grinding wheel 1 is provided with three arcuate depressions which are uniformly distributed over the periphery, so as to form a diameter difference $t_2$ corresponding to the difference between the smallest and greatest diameter of the grinding disc as considered in a peripheral direction. The difference $t_2$ which is identified hereinbelow as an amplitude, corresponds to the difference $t_1$ of the workpiece which is produced from the greatest and smallest diameter in its cross-section. Thereby, a continuous abutment is provided between the workpiece 5 on the one hand and the grinding disc 1 on the other hand, so as to produce the respective profile.

Figure 4:
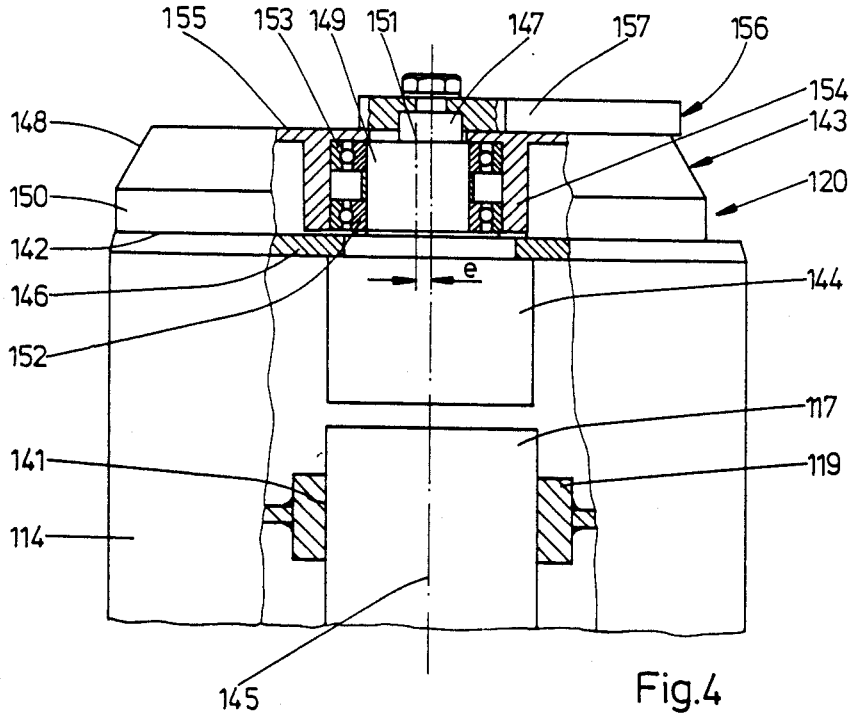
FIG. 4 is a plan view of a grinding wheel which is inclined to a workpiece and a dressing roller.
Figure 5:
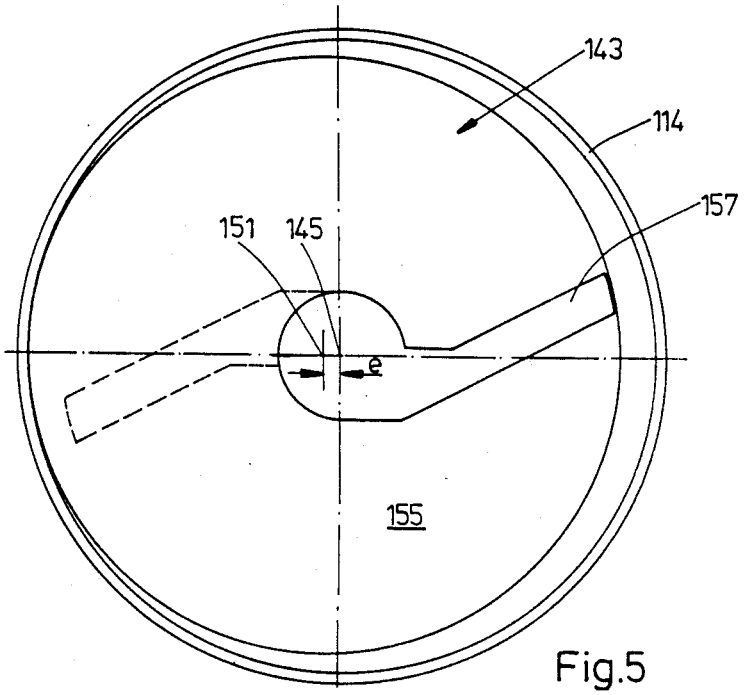
FIG. 5 is a view showing vectors of the speeds of the method in accordance with the present invention.

In the embodiment of FIG. 4 the grinding wheel 1 for performing the inventive method is arranged in an inclined position relative to the plane between the diamond dressing roller 3 and the workpiece 5. This angle can have the value of 25°. Such an inclined position is required for producing with the given cutting speeds a desired grinding effect. In FIG. 5 $V_s$ identifies the speed of the grinding wheel and $V_r$ identifies the resultant in the axial direction of the workpiece which causes the above explained grinding effect.

The new process of the kinematically coupled grinding is not limited only to the above described profile as shown in FIG. 3. It is possible by respective selection of the ratio between the rotary speeds of the grinding wheel and the workpiece to produce multiple threads of different pitches with a singularly profiled grinding wheel and a singularly profiled dressing roller. When the grinding wheel and the workpiece with a singular thread of the grinding wheel 1 have the same number of revolutions, also a singular thread is produced on the workpiece 5. When to the contrary the number of revolutions of the workpiece 5 is for example doubled, a double thread is produced.

Figure 6:
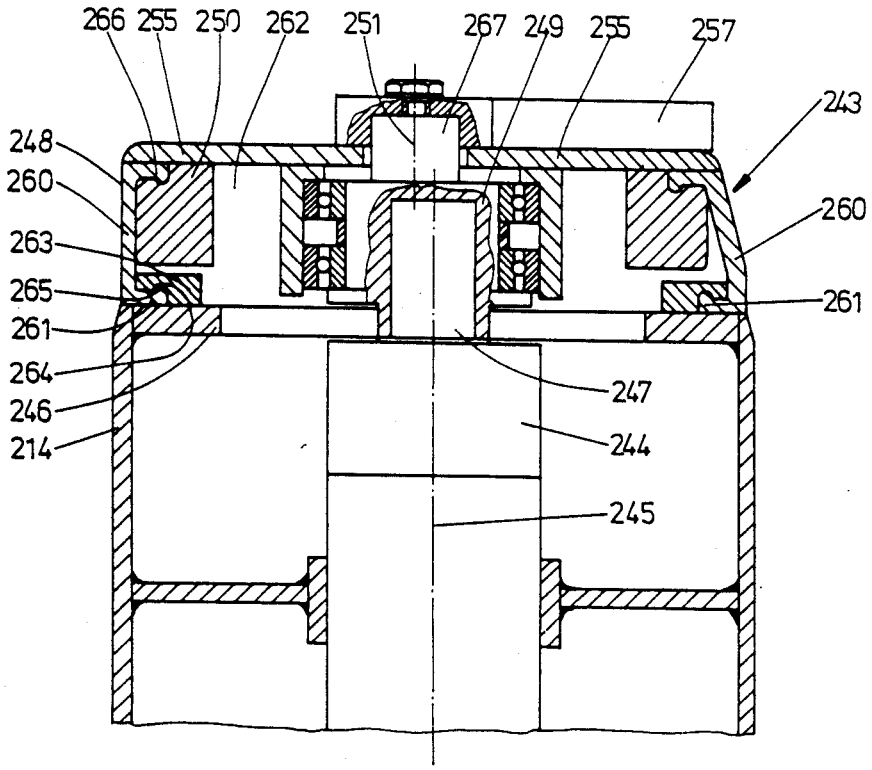
FIG. 6 is a view showing a longitudinal section of a profiled grinding wheel.
Figure 7:
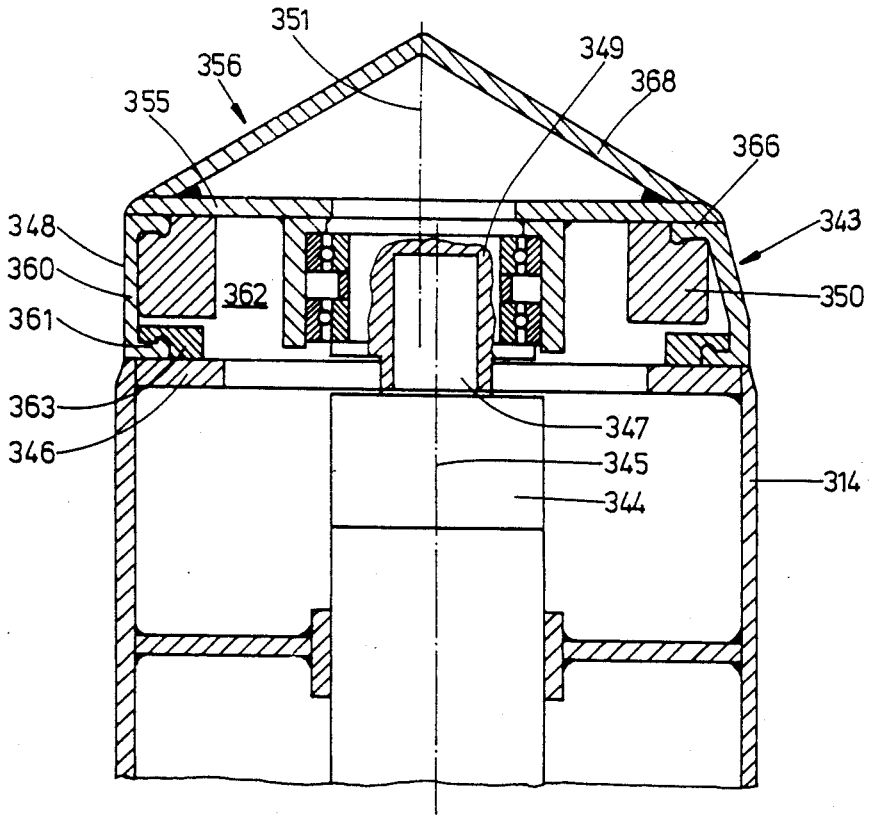
FIG. 7 is a side view of a drive of the arrangement for profiled grinding in accordance with the present invention.

By reversing the rotary direction of the workpiece, the pitch of the thread can be changed for example from the left thread to the right thread. It is also possible to use grinding wheels with different profile designs as shown in FIG. 6.

FIGS. 7 through 11 shows a drive and a transmission for driving the grinding wheel, the workpiece and the dressing roller of the inventive arrangement. The drive includes a main drive motor 101, an adjusting motor 103 for a workpiece 114, an adjusting motor 104 for a dressing tool 113, and a regulating unit for regulating the rotary speed of the main motor and the adjusting motors. Reference numerals 105, 106 identify exchangeable belt pulley for rotating the grinding wheel 117, and the workpiece 114 and the dressing roller 113. Reference numerals 107 and 109 identify exchangeable pulleys for rotating the dressing roller 113. Reference numerals 108 and 110 identify exchangeable pulleys for rotating the workpiece 114. 111 and 112 are bearing blocks for shaft 161 and 162, while 115 and 116 are supports for the workpiece 114 and the dressing roller 113. Deviating rollers are identified with reference numeral 118, springs are identified as 119, and a sliding block is identified as 120. The left pulleys of the arrangement are identified with 140, 141 and 150, while the drive shafts are identified as 160, 161 and 162.

For driving the grinding wheel 117 as well as the associated dressing roller 113 and the workpiece 114, the single drive motor 1 is provided. The adjusting motor 14 is used for the adjustment of the dressing roller 13 transversely to the axis so that the dressing roller 13 can reciprocate in accordance with the double arrow 36. For displacing the workpiece 114 transversely to the axis in correspondence with the double arrow 35, it is arranged on a reciprocable support 115 which is connected with the adjusting motor 103 for imparting the reciprocating movement.

The regulation of the rotary speed of the main drive motor 101 and both adjusting motors 103 and 104, a joint electronic regulating unit 102 is provided. The regulating unit 102 is connected with all three motors.

The main drive motor 101 is connected with the main drive shaft 160 by the drive belt 150. The main drive shaft 160 carries the grinding wheel 17. The drive belt 150 runs over exchangeably arranged belt pulleys 105 and 106. By an exchange of the belt pulleys 105 and 106 for greater or smaller belt pulleys, the rotary speed of the grinding wheel 117, as well as of the workpiece 114 and the dressing roller 113 can be changed.

The drive shaft 161 for the dressing roller 113 and the drive shaft 162 for the workpiece 114 run parallel to the main drive shaft 160. These shafts are supported in two bearing blocks 111 and 112. The shaft 161 is connected with the main shaft 160 by a drive belt 140, while the shaft 162 is connected with the main drive shaft 160 by a belt 141.

The belt 140 runs over two belt pulleys 107 and 109 which are arranged exchangeably. The belt 141 runs over two belt pulleys 108 and 110 which are also exchangeable. This exchangeability provides for the possibility to change both the ratio of the rotary speeds of the dressing roller 113 to the grinding wheel 117, and the ratio of the rotary speed of the workpiece 114 to the grinding wheel 117 or both relative to the grinding wheel 117.

Figure 8:
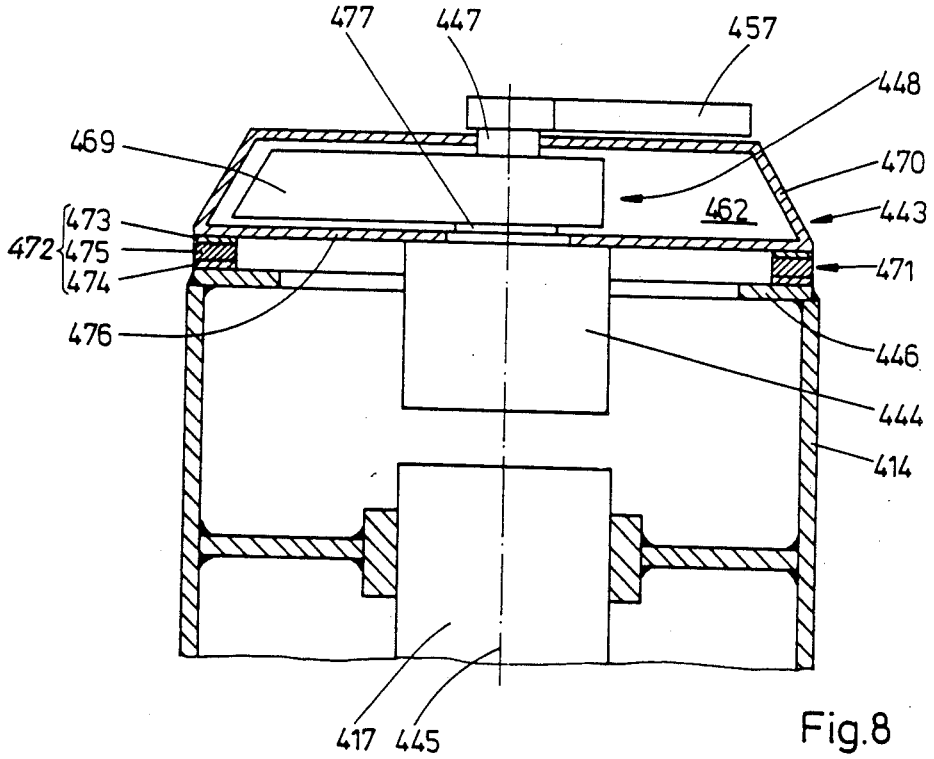
FIG. 8 is an end view of the drive of the inventive arrangement of FIG. 7.

FIG. 8 is a side view of the arrangement taken along the line VIII—VIII and showing the drive. In this example, the diameters of the exchangeable belt pulleys 107, 108, 109 and 110 are of the same size. The belts 140 and 141 are guided on the deviating rollers 118 which are supported on displaceable sliding blocks 20. The latter are arranged under the pulling action of the springs 119 to hold the drive belts 140 and 141 under the tension. The arrangement of the sliding blocks 120 with the spring 119 is provided for tensioning the belts 140 and 141 also when the exchangeable belt pulleys are replaced by larger or smaller pulleys. Such possibilities are shown in FIGS. 9 and 10.

Figure 9:
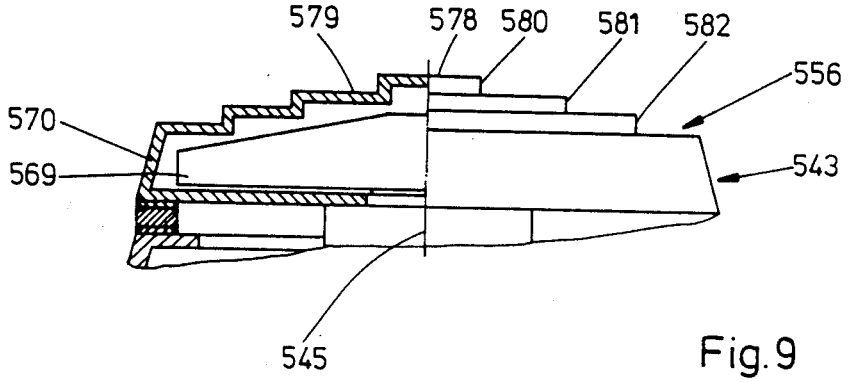
FIGS. 9 and 10 are views showing in detail portions of the drive of the arrangement in accordance with the present invention.
Figure 10:
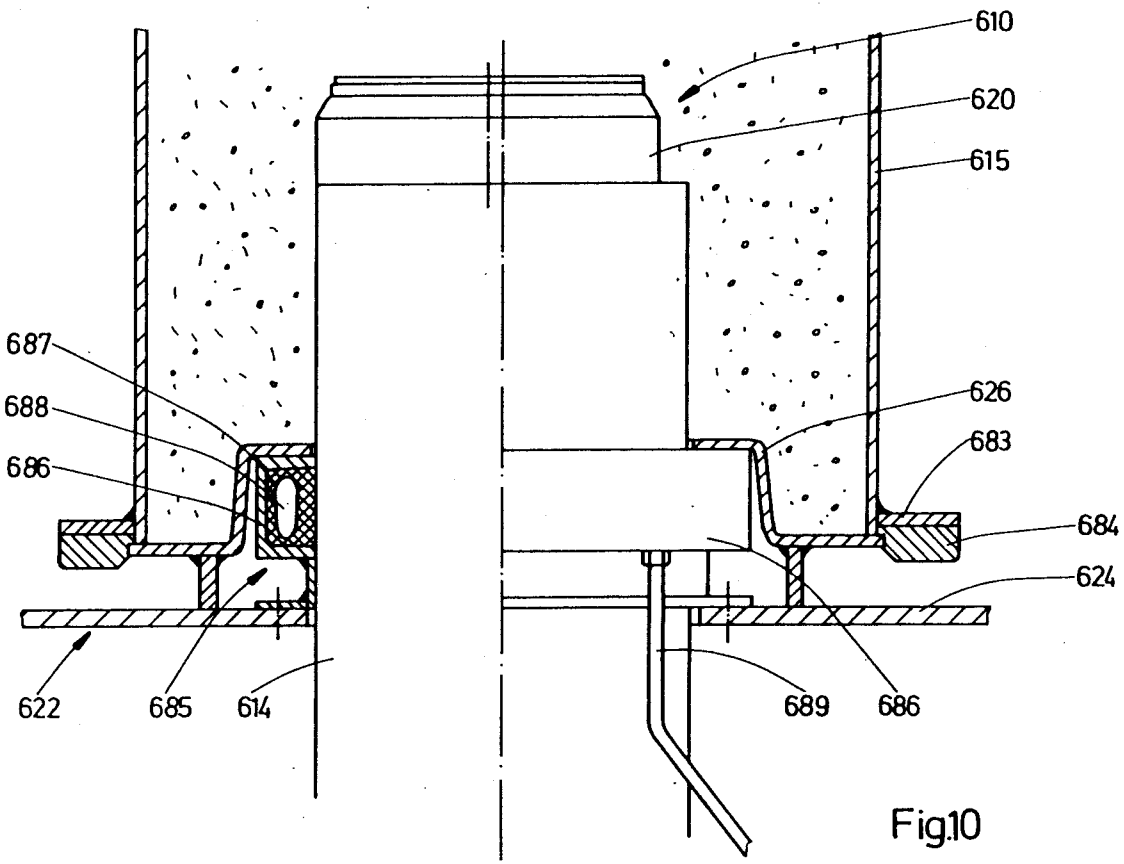
Figure 11:
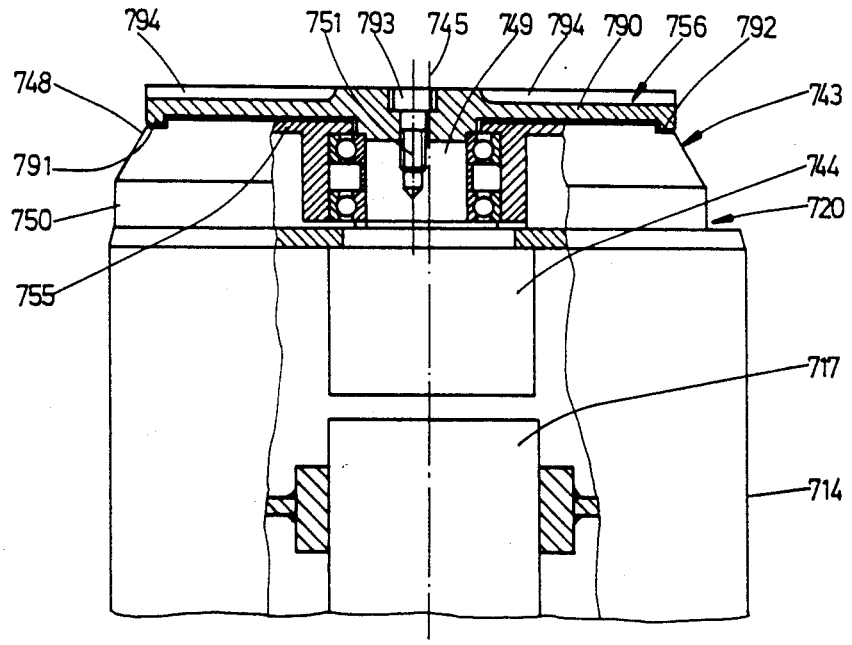
FIG. 11 illustrates means for supporting the grinding disc, the workpiece and the dressing roller of the inventive arrangement.

In FIG. 9 the belt pulley 107 for the drive of the dressing roller 117 and the belt pulley 108 for the drive of the workpiece are greater than in the example of FIG. 8, so the shafts 161 and 162 and thereby the dressing roller 113 and the workpiece 114 have a ratio of the rotary speeds for example 1:2 relative to the grinding wheel 117. In contrast the pulleys 107 and 108 have smaller diameters than for the drive of the main shaft 160, so that here a ratio is provided of 2:1.

The belt pulleys 105, 106, 107, 108, 109 and 110 not be of a special design for their exchangeability, but instead can be formed conventionally. For exchanging of the belt pulleys, it suffices to lose a nut on the shaft to move the belt pulley, so that afterwards a greater or smaller belt pulley can be arranged for changing the rotary speed ratio between the grinding wheel on the one hand and the dressing roller and the workpiece on the other hand.

Figure 12:
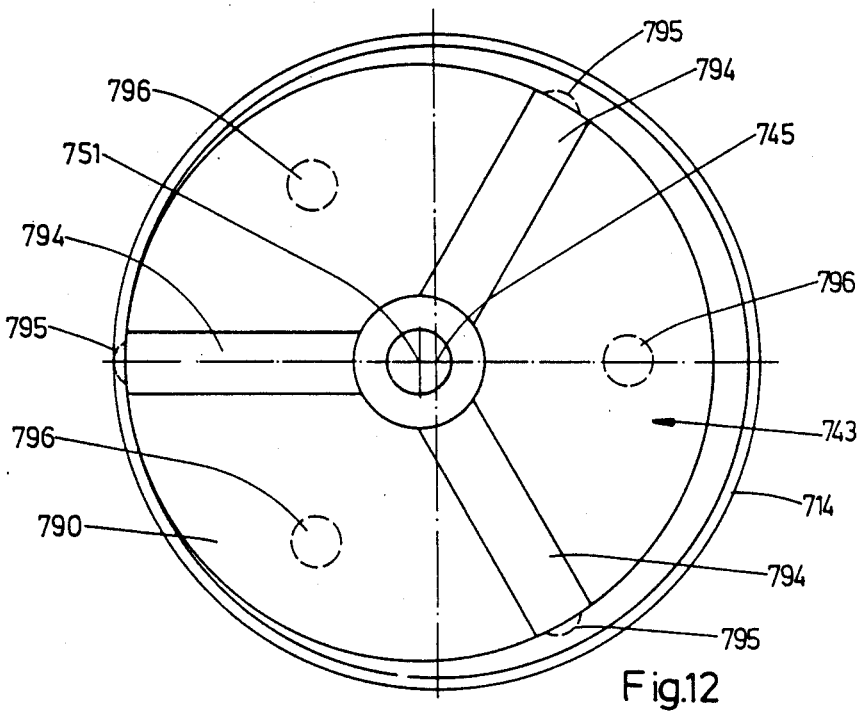
FIG. 12 is a view schematically showing working part of the inventive arrangement with the grinding wheel, the workpiece and the dressing roller.
Figure 1:
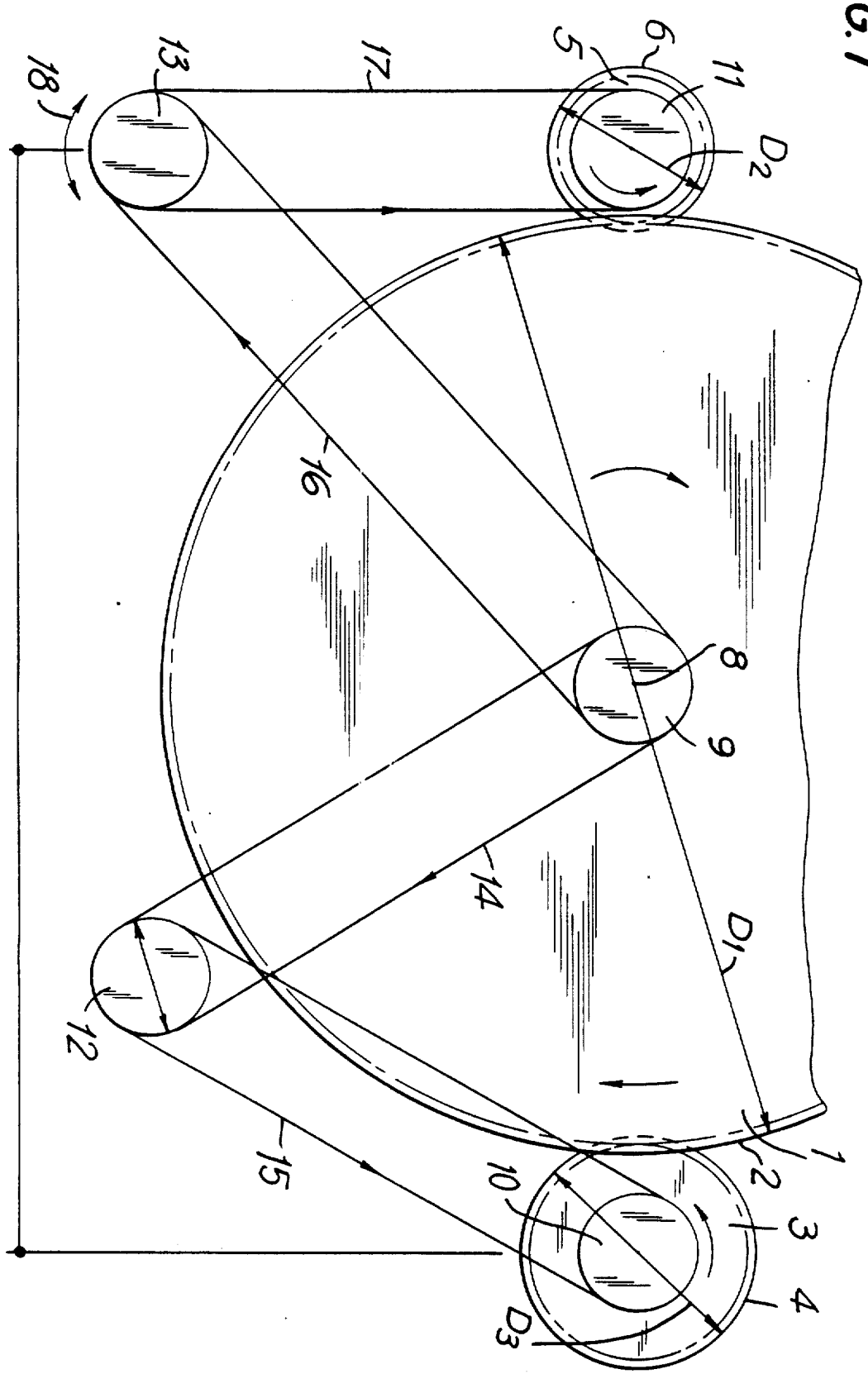
Figure 2:
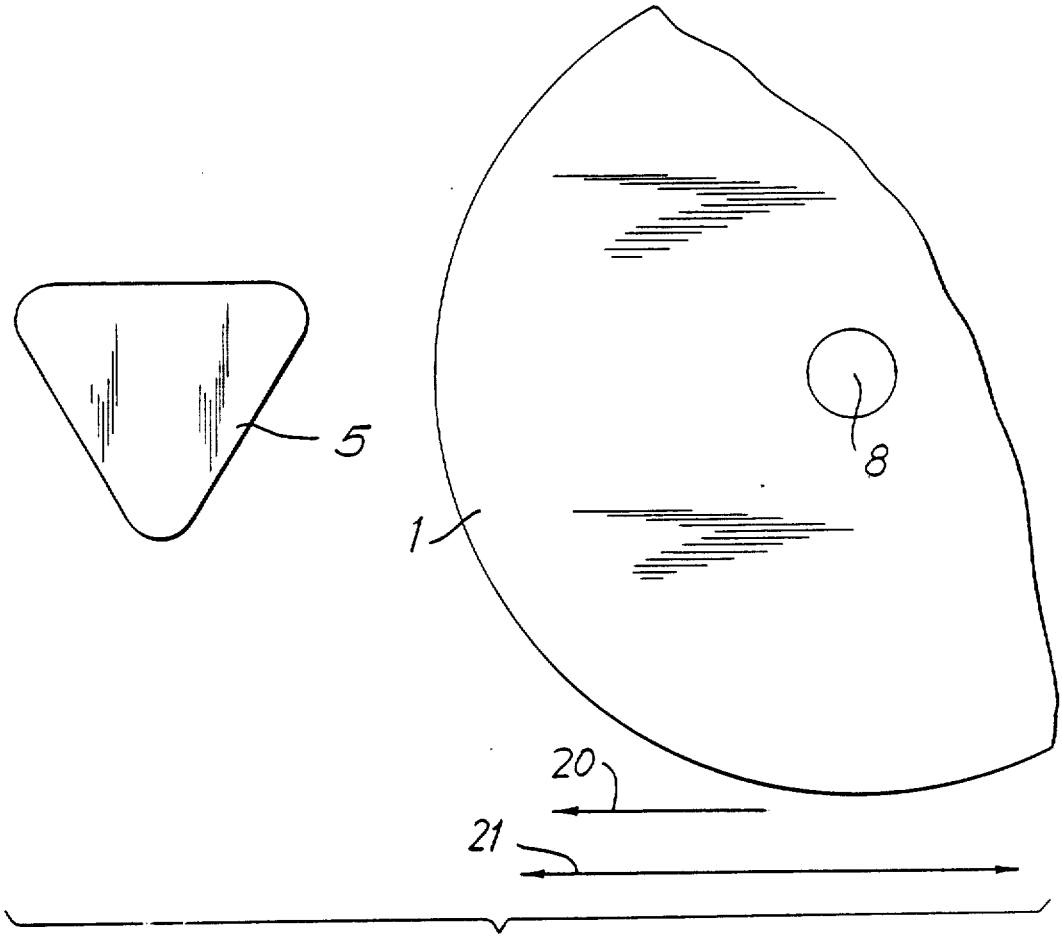
FIG. 2 PRIOR ART
Figure 3:
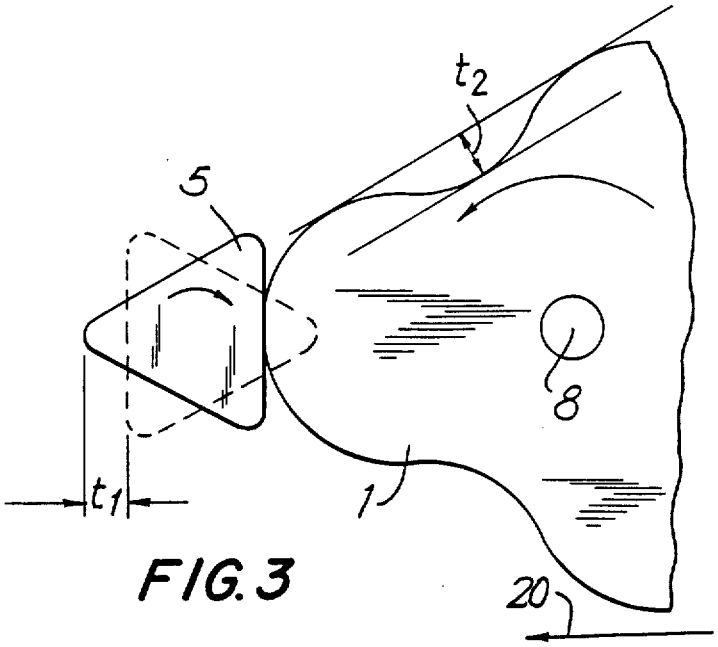
Figure 4:
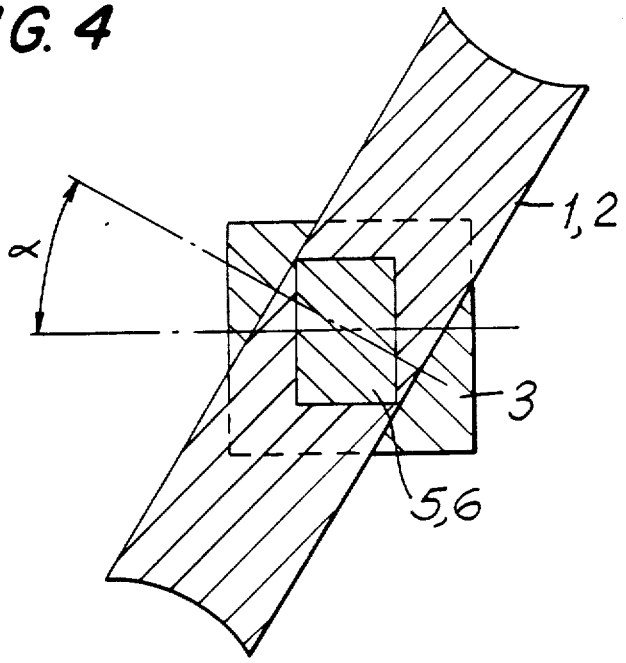
Figure 5:
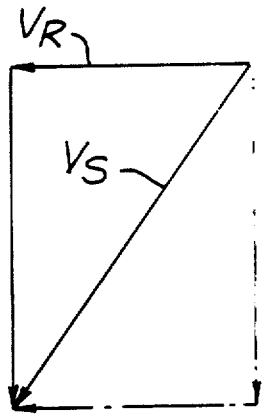
Figure 6:
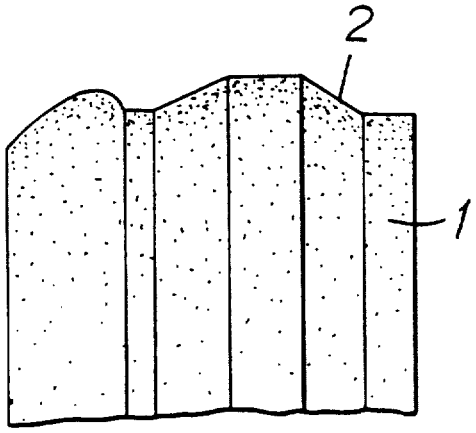
Figure 7:
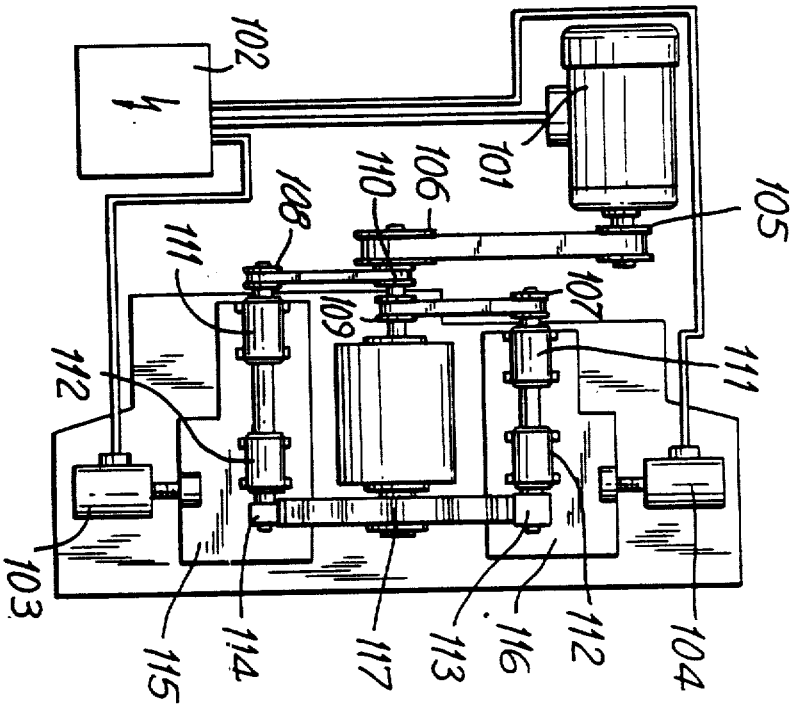
Figure 8:
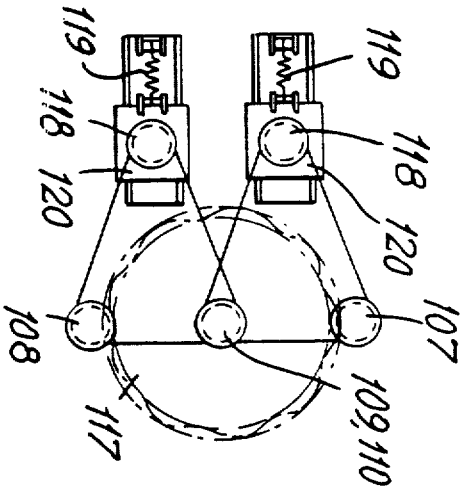
Figure 9:
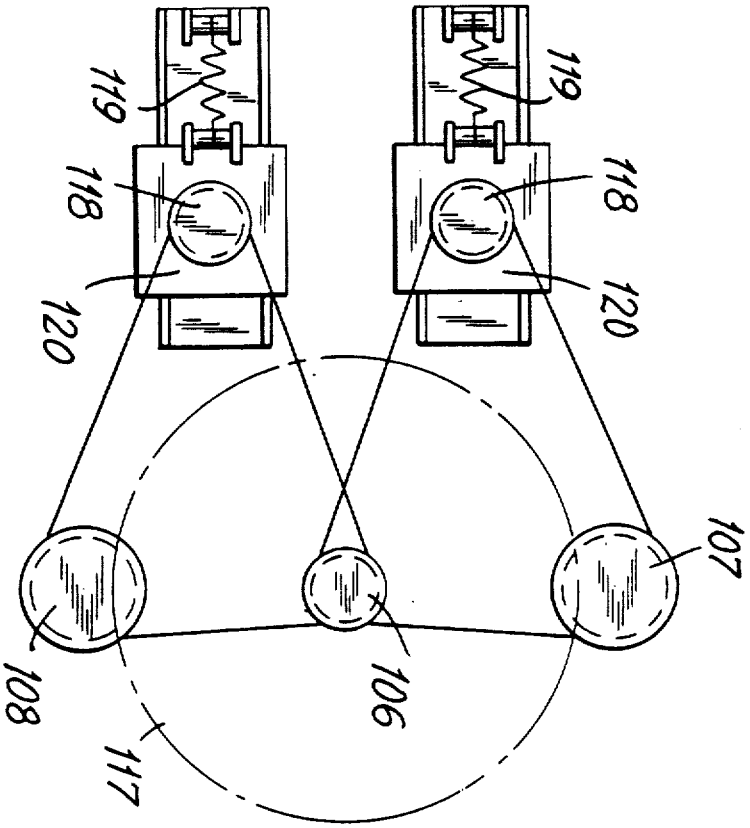
Figure 10:
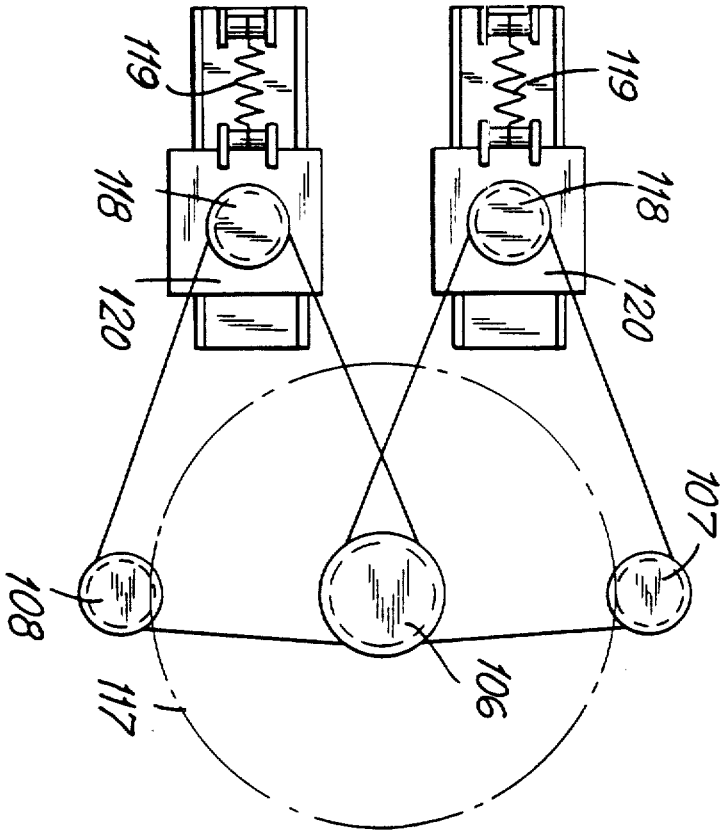
Figure 11A:
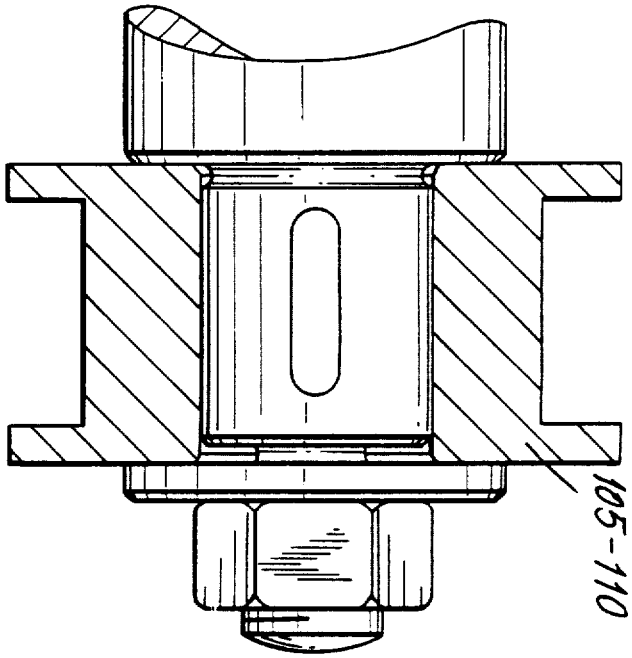
Figure 11B:
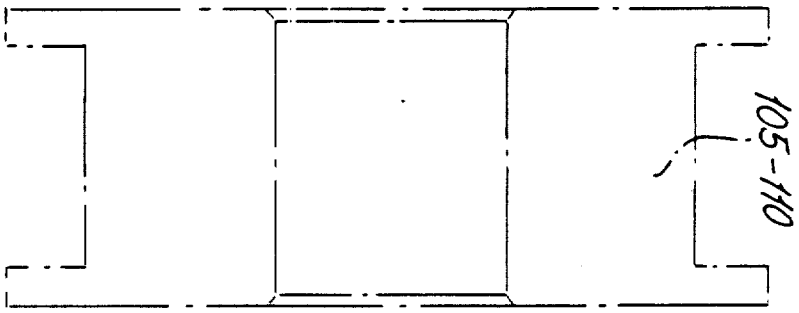
Figure 11C:
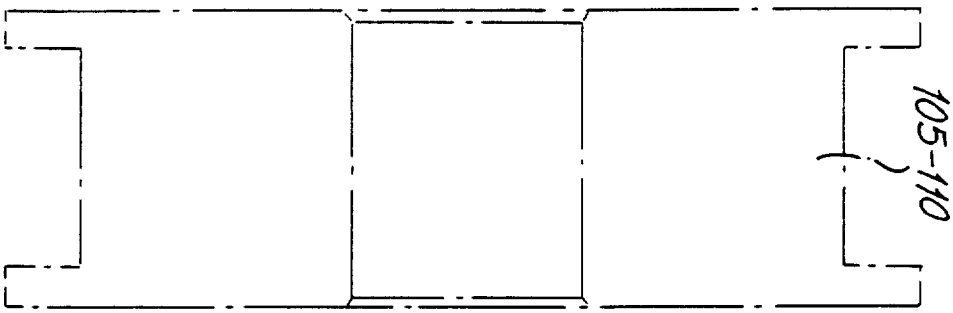
Figure 12:
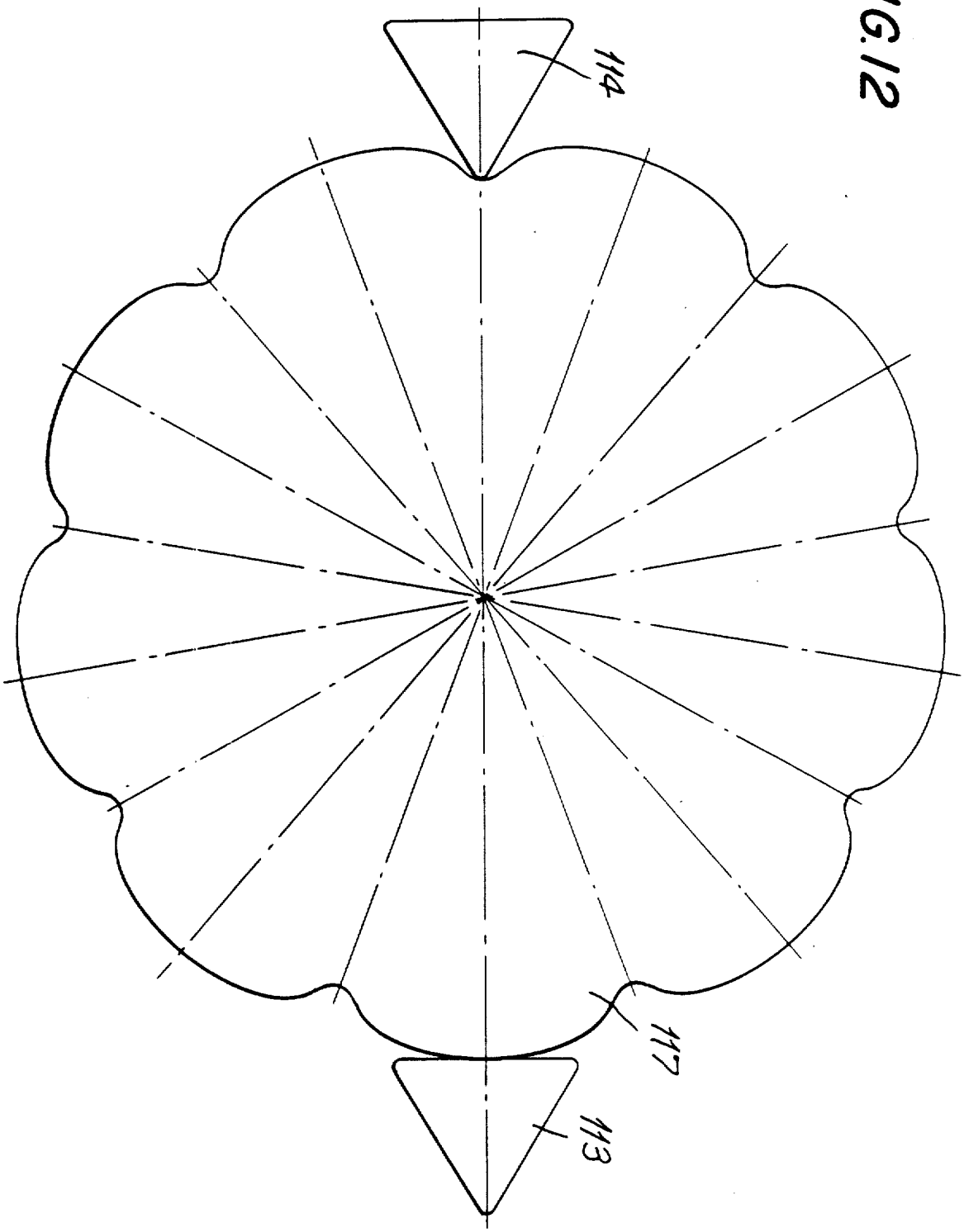

The rotary speed ratios depend on the shape of the workpiece 114 to be worked or its geometry, as well as on the special property of the grinding wheel 117 and the property of the dressing roller 113 in FIG. 12.

It should be emphasized that by an exchange of the belt pulleys 105 and 106 the rotary speed of the grinding wheel 117 can be changed by simultaneously the rotary speed of the workpiece 114 and the dressing tool 113 can be changed since the main drive acts on them through the main drive shaft 116. Independently from this, the pulleys 109 and 110 are arranged on the main drive shaft 60 can be exchanged, for changing the rotary speed ratio between the grinding wheel 117, on the one hand and the dressing roller 113 and the workpiece 114 on the other hand. Instead of exchanging the pulleys 109 and 110, also an exchange of the belt pulleys 107 and 108 can be performed.

The exchangeability of belt pulleys 105 and 106 for the purpose of the joint rotary speed change is however is not important, since the rotary speed of the shaft 160 and thereby the grinding wheel 117 as well as the rollers 116 and the workpiece 114 can be changed by a stepless regulation of the motor 101 through the regulating unit 102.

It should be mentioned that the drives for the dressing roller 113 and the workpiece 114 extend from the drive for the grinding wheel, as is clearly shown in the drawing. It should be also mentioned that in the shown examples the grinding wheel is not adjusted relative to the workpiece 114 and the dressing roller 113, but vice versa. In other words, the dressing roller and the workpiece are adjusted or displaced toward the grinding wheel as explained hereinabove. However, it does not exclude that in accordance with the present invention it is possible to adjust the grinding wheel 117 and the dressing roller 113 together relative to the workpiece 114.

It should be mentioned that the inclined position of the grinding wheel 117 relative to the workpiece 114 is not absolutely necessary. However, it is desirable since the inclined position provides for a relative movement in the grinding wheel 117 and the workpiece 114 to be worked in direction toward the axis of the workpiece. Thereby an additional grinding speed is produced, which superposes on the original grinding speed.

It will be understood that each of the elements described above, or two or more together, may also find a useful application in other types of constructions differing from the types described above.

While the invention has been illustrated and described as embodied in an arrangement for grinding workpieces with profiles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of grinding of non-round workpieces by a plunge cutting on circular grinding machines, comprising the steps of kinematically coupling a non-round grinding wheel having a plurality of portions with different diameters arranged on regularly repeated angular positions and having different amplitudes, with a workpiece so that a rotary speed of the workpiece and a rotary speed of the non-round grinding wheel are determined relative to one another, grinding the workpiece in condition of its kinematic coupling with the non-round grinding wheel providing relative movement between the workpiece and the grinding wheel during grinding, dressing the non-round grinding wheel with the dressing roller kinematically coupled with the non-round grinding wheel to provide predetermined ratios of rotary speed between the grinding wheel, the dressing roller and the workpiece whereby a predetermined non-round workpiece profile is achieved.

2. A method as defined in claim 1, wherein said grinding includes grinding with the grinding wheel which has diameter differences in a peripheral direction of the grinding wheel amounting to 0.5–60mm.

3. A method as defined in claim 1, wherein the dressing of the non-round grinding wheel and the grinding of the workpiece are performed in an inclined position of the non-round grinding wheel relative to the dressing roller and the workpiece.

4. An arrangement for grinding non-round workpieces in plunge cutting on circular grinding machines, comprising a non-round grinding wheel having a plurality of portions with different diameters arranged on regularly repeating angular positions and having different amplitudes; a dressing roller kinematically coupled with said grinding wheel means providing relative movement between said workpiece and said grinding wheel during grinding; and means for kinematically coupling said grinding wheel with the workpiece so that a grinding of the workpiece is performed with said non-round grinding wheel kinematically coupled with the workpiece to provide predetermined ratios of rotary speeds between said grinding wheel, said dressing roller and the workpiece whereby a predetermined non-round workpiece profile is achieved.

5. An arrangement as defined in claim 4, wherein said non-round grinding wheel is inclined relative to said dressing roller and said workpiece.

6. An arrangement as defined in claim 4, wherein said dressing roller and the workpiece have axes which extend parallel to one another.

7. An arrangement as defined in claim 4, wherein said grinding wheel has diameter differences in a peripheral direction of the grinding wheel amounting to 0.5–60mm.

* * * * *

UNITED STATES PATENT AND TRADEMARK OFFICE

CERTIFICATE OF CORRECTION

PATENT NO. : 4,974,367

DATED : Dec. 4, 1990

INVENTOR(S) : Wlodzimierz Sawluk

It is certified that error appears in the above-identified patent and that said Letters Patent is hereby corrected as shown below:

The title page, showing the illustrative figure, and Drawing Sheets 1-9, should be deleted and substitute therefor the attached title page and 7 Drawing Sheets, consisting of FIGS. 1-12.

Signed and Sealed this

Thirtieth Day of June, 1992

*Attest:*

DOUGLAS B. COMER

*Attesting Officer*

*Acting Commissioner of Patents and Trademarks*

United States Patent [19]

Sawluk

[11] Patent Number: 4,974,367

[45] Date of Patent: Dec. 4, 1990

[54] METHOD OF AN ARRANGEMENT FOR GRINDING WORKPIECES WITH PROFILES

[75] Inventor: Wlodzimierz Sawluk, Hamburg, Fed. Rep. of Germany

[73] Assignee: Firma Ernst Winter & Sohn (GmbH & Co.), Hamburg, Fed. Rep. of Germany

[21] Appl. No.: 455,636

[22] Filed: Dec. 22, 1989

Related U.S. Application Data

[63] Continuation-in-part of Ser. No. 223,601, Jul. 25, 1988, abandoned.

[30] Foreign Application Priority Data

Jul. 29, 1987 [DE] Fed. Rep. of Germany ..... 3725024

[51] Int. Cl.[5] ..... B24B 7/00

[52] U.S. Cl. ..... 51/5 D; 51/288; 51/325

[58] Field of Search ..... 51/5 D, 288, 325; 125/11 C, 11 D

[56] References Cited

U.S. PATENT DOCUMENTS

| | | | |
|---|---|---|---|
| 2,981,038 | 4/1961 | Flanders | 51/288 |
| 3,243,923 | 4/1966 | Karavias | 51/288 |
| 3,403,479 | 10/1968 | Ferreirinha | 51/105 |
| 3,524,283 | 8/1970 | Jones | 51/5 |
| 3,553,893 | 1/1969 | Stade | 51/5 |
| 3,943,664 | 3/1976 | Broide et al. | 51/5 D |

FOREIGN PATENT DOCUMENTS 3238691 4/1984 Fed. Rep. of Germany .

*Primary Examiner*—J. J. Hartman
*Attorney, Agent, or Firm*—Michael J. Striker

[57] ABSTRACT

Grinding of non-round workpieces with plunge cutting on circular grinding machines is performed by a grinding disc which is coupled with a dressing roller and which is also kinematically coupled to a workpiece, so that the grinding is performed in condition of the kinematic coupling.

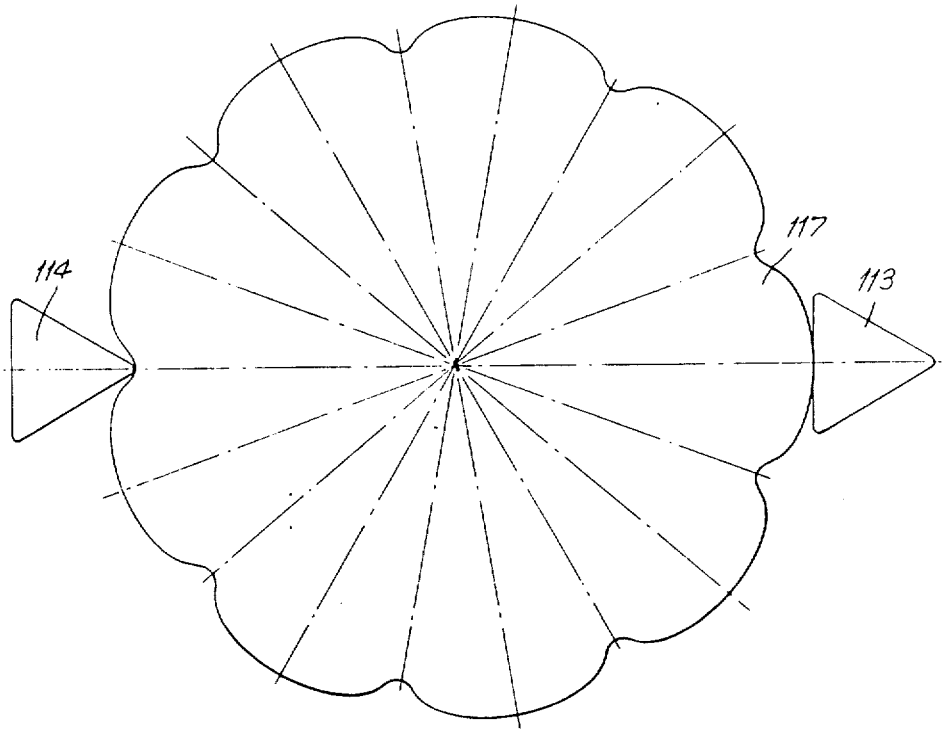

7 Claims, 7 Drawing Sheets